United States Patent [19]

Peters

[11] Patent Number: 4,516,455

[45] Date of Patent: May 14, 1985

[54] THREE-KNIFE TRIMMER

[75] Inventor: Gerd Peters, Langenhagen, Fed. Rep. of Germany

[73] Assignee: H. Wohlenberg KG GmbH & Co., Hanover, Fed. Rep. of Germany

[21] Appl. No.: 436,608

[22] Filed: Oct. 25, 1982

[30] Foreign Application Priority Data

Jan. 19, 1982 [DE] Fed. Rep. of Germany ..... 3201836

[51] Int. Cl.[3] ..... B26D 5/08

[52] U.S. Cl. ..... 83/519; 83/925 A

[58] Field of Search ..... 83/214, 925 A, 311, 83/324, 513, 519

[56] References Cited

U.S. PATENT DOCUMENTS

| | | | |
|---|---|---|---|
| 442,295 | 12/1890 | Seybold | 83/925 A X |
| 2,214,488 | 9/1940 | Stern et al. | 83/324 X |
| 3,146,650 | 9/1964 | Sarring et al. | 83/925 A X |
| 3,528,332 | 9/1970 | Thumim | 83/214 |
| 3,690,208 | 9/1972 | Muller | 83/925 A X |
| 4,208,932 | 6/1980 | Anderson | 83/311 X |

FOREIGN PATENT DOCUMENTS

| | | |
|---|---|---|
| 1963861 | 2/1969 | Fed. Rep. of Germany . |
| 2826476 | 7/1977 | Fed. Rep. of Germany . |

*Primary Examiner*—Frank T. Yost

*Attorney, Agent, or Firm*—Manfred M. Warren; Robert B. Chickering; Glen R. Grunewald

[57] ABSTRACT

The invention concerns a three-knife trimmer, in which for the purpose of cutting on three sides stacks of books, brochures, or the like, first the side knives and then the front knife, or vice versa, are operated to carry out the cut by a single-revolution shaft, during one revolution, by means of intermediate gears at a single location, whereby the drive system for the knives consists of a guide unit and an operating unit preceding it, which operating unit is comprised of a gear unit (13, 14, 15, 16, 17) with a gear ratio that changes during one revolution of the single-revolution shaft (12). This yields a simple gear system with few parts that is simple in construction, is stable in the path of transmission and shows a harmonic motion pattern, so that the machine can operate at high speeds. The gear unit consists of three gear wheels (13, 14, 15), the axis of the first of which is connected eccentrically with the single-revolution shaft (12) and meshes, through an intermediate wheel (14) with movable turning axis (18), with the third gear wheel (15), which is mounted on the axis of the guide unit (19) that drives the knife assembly, and there is located between the axis of the intermediate wheel (14) and the axes of the first and third gear wheels (13, 15) one guide rod (16, 17) each, which is capable of turning.

7 Claims, 6 Drawing Figures

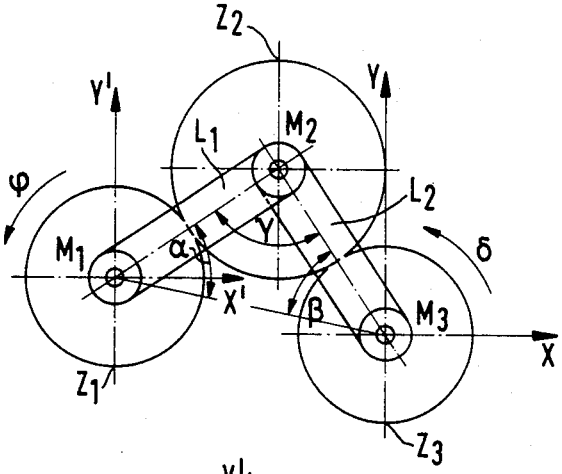
FIG. 1
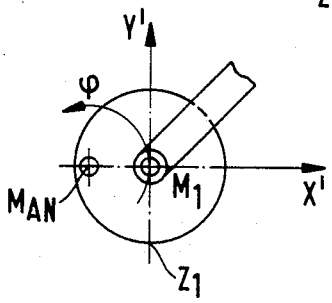
FIG. 2
FIG. 3
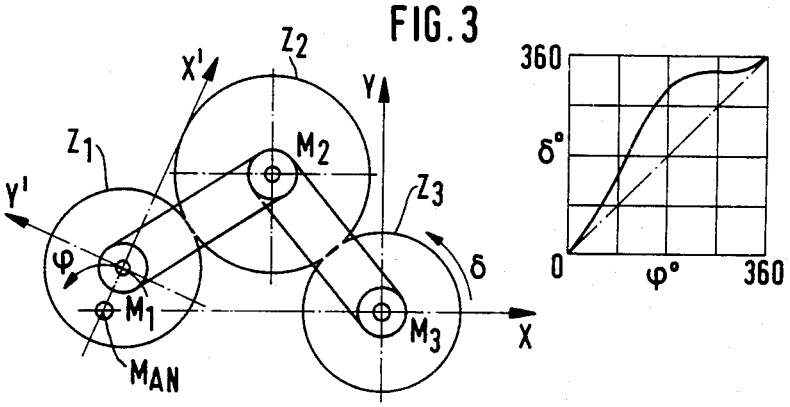

THREE-KNIFE TRIMMER

BACKGROUND OF THE INVENTION

Three-knife trimmers for the three-sided cutting of stacks of books, brochures or the like are well known, the material to be cut being automatically brought to the cutting table, aligned there under the knives and held down on the cutting table by a pressure plate. The two side knives are immediately operated at the same time, in order to trim the head and foot of the stack, and then in a second work operation the front knife cuts the front of the stack, whereupon the cut material is automatically removed from the cutting table and leaves the machine by means of a conveyor belt.

This cutting sequence, which can also be reversed, is necessary because the side and front knives have to be longer than the material to be cut and therefore would be in each other's way in the case of simultaneous motion. In this regard, a familiar technique is to use a step-by-step switch, which controls the motions of the two side knives and the front knife in sequence.

Because of the time sequence of two work operations in cutting the material stack, the efficiency of the machine is naturally limited. The linking of machinery in book production lines requires, however, an increase in work tempo, since a three-knife trimmer of the type built up to now, when integrated into these high efficiency production lines, represents the slowest link in production and does not permit an optimal work tempo.

In contrast to three-knife trimmers with a single cutting station, two-station-flow line cutters are also known, which in contrast to the three-knife trimmer carry out the cut in two cutting stations, cutting the head and foot of the stack at the first station and the front in the following. Assembly line cutters are expensive, however, on account of their complicated construction, for additional measures must be taken to direct the stack of material being cut to the second station and to remove it from the latter, whereby the accuracy of the cut can suffer from the necessity of repositioning the stack. Besides, the problem of transportation limts the height of the stack, so that the advantage of increased pace must be purchased at a cost of decreased efficiency, so that no significant improvement of performance over the familiar three-knife trimmer can be achieved.

Further research in the direction of increased work tempo has thus concentrated on improvement of knife drive mechanisms in the three-knife trimmers.

DE-OS No. 28 26 476 has revealed the method of swinging the front knife away from the path of the side knives, after the former has completed its cut, so that the side knives can carry out their cuts immediately following.

It has been shown, however, that use of mechinery in high efficiency production lines requires considerable operating speeds, so that with the considerable masses which must be accelerated and decelerated, a speed limit is soon reached, if the motions are not harmonic. This is the case, however, when immediately following a cutting movement a very quick swinging movement of the knife is carried out, which runs in a different direction from the cutting movement. Besides, the knife is inclined to bend during the cut because of its swivel mounting.

From DE-PS No. 19 63 861 a three-knife trimmer is familiar, in which the movements of the knives are derived from the so-called single-revolution shaft of the machine. The movements of the side knives and the front knife come about one after the other, as before, during a revolution of the single-revolution shaft; however, the mechanism between the single-revolution shaft and the knife holders is so designed that not only the side knives but also the front knife remain for a period of time above the area of cut, so that this period of time is available for the exact positioning of the stack of material being cut.

The drive mechanism for the knife holders consists in this case of a series arrangement of guide unit, which guides the knife, and operating unit, which precedes the other. The guide unit raises and lowers the attached knife assembly, while the operating unit controls the time of operation of the guide unit according to a given function. The units consist of a chain of ten gear elements each. The numerous elements, however, lead to a high total tolerance of bearing play and a high elasticity of the entire chain, which can have a bad effect on the movement of the knives, e.g. at bottom dead center at the conclusion of the cut and the simultaneous reversal of the motion, when the long chain, having been strained under the force of the cut, relaxes again.

The invention is based on a three-knife trimmer of the last-named type, in which first the side knives and then the front knife, or vice versa, are operated to carry out the cut by a single-revolution shaft, during one revolution, by means of intermediate gears at a single location, whereby the drive system for the knives consists of a guide unit and an operating unit preceding it.

SUMMARY OF THE INVENTION

The object of the invention is to design the knife drive of such a three-knife trimmer in such a way that the drive chain requires few moving parts and forms a stable path of transmission, and that the elements lying in the drive path carry out harmonic movements.

This object is attained in the invention by designing the operating unit as a gear unit with a gear ratio that changes during a revolution of the single-revolution shaft.

The use of gear wheels for the operating unit has the advantage that a stable path of transmission is achieved, because the gear wheels support each other and the distances between centers of meshing gear wheels do not change, even under load. Besides, translatory movements, which in the case of the gear unit of the invention are superimposed on the rotational movements of the gear wheels, are significantly more uniform than the reciprocal movements of levers in the operating unit or the known machine.

In the embodiment of the invention the gear unit consists of three gear wheels, of which the axis of the first is connected eccentrically with the single-revolution shaft of the first and meshes, through an intermediate wheel with moveable turning axis, with the third gear wheel, which is mounted on the axis of the guide unit that drives the knife assembly. The changing gear ratio arises in this arrangement from the fact that, depending on the angular position of the first gear wheel, the position of the intermediate wheel is changed and thereby the third gear wheel experiences a peripheral speed differing from the first gear wheel. The fact that the first and the third gear wheels have a gear ratio of 1:1 assures that in a revolution of the single-revolution shaft, and thus in a revolution of the first gear wheel, the third gear wheel will have carried out one revolution too.

By means of guide rods located between the axis of the intermediate wheel and the axes of the first and third gear wheels, which are of the same length and capable of turning, the distances of the axes of the first and third gear wheels from the axis of the intermediate wheel are fixed.

DESCRIPTION OF THE DRAWINGS

The invention is further clarified in the following with reference to the drawings. In the drawings, FIG. 1 indicates an arrangement of three gear wheels to illustrate the operation of a gear unit with variable gear ratio designed according to the invention;

FIG. 2 indicates the eccentric coupling of the drive gear wheel of the arrangement illustrated in FIG. 1;

FIG. 3 indicates the combination of FIGS. 1 and 2 into the operating unit used in the three-knife trimmer according to the invention;

DESCRIPTION OF THE PREFERRED EMBODIMENTS

FIG. 1 shows a gear wheel unit with three meshing gear wheels $Z_1$, $Z_2$ and $Z_3$. Assuming, for explanatory purposes only, that the centers $M_1$, $M_2$ $M_3$ are immovably located, the gear ratio of the unit is determined by the gear wheels $Z_1$ and $Z_3$, since the intermediate wheel $Z_2$ has no influence on the gear ratio. The point of tooth engagement lies not only on the line of contact but also on the line between centers of the gear wheels in question.

If one connects the centers of the three gear wheels with two guide rods $L_1$ and $L_2$, and if the center $M_3$ of gear wheel $Z_3$ is defined as the origin of an X-Y coordinate system, the gear ratio varies as $M_1$ changes its coordinates. The shift can occur not only in the X direction but also in the Y direction. The triangle defined by the centerpoints $M_1$, $M_2$, $M_3$ changes its angles thereby.

In other words, this means that if centerpoint $M_1$ is immovable in the X-Y coordinate system every change in the drive angle $\phi$ in proportion to the number of teeth of gear wheels $Z_1$ and $Z_3$ creates a corresponding final drive angle $\delta$ on gear wheel $Z_3$ (function of a normal fixed-gear unit), while under the assumption that an X'-Y' coordinate system is defined by the centerpoint $M_1$ of gear wheel $Z_1$ and centerpoint $M_1$ is not fixed, every parallel shift of the X'-Y' coordinate system with respect to the X-Y coordinate system produces at gear wheel $Z_3$ an additional change in the final drive angle $\delta$. For these reasons, it should be clear that the degree of freedom of gear wheel $Z_1$ permits alteration of the final drive angle $\delta$, which departs from the gear ratio given by the number of teeth of the gear wheels $Z_1$ and $Z_3$. If the three partial movements in the X direction, the Y direction and the $\phi$ direction are carried out simultaneously, the total angular change is given by the sum of the partial angular changes. They can be positive or negative mathematically and thus affect the angular speed of the final drive wheel unevenly, i.e. the gear ratio varies.

On the basis of these considerations the gear wheel $Z_1$ of FIGS. 2 and 3 is mounted eccentrically at $M_{AN}$ so that it can turn freely and is driven at constant speed. The point $M_{AN}$ is a fixed point in the X-Y coordinate system experiences simultaneously an angular shift and a parallel shift of coordinates.

With a gear unit of this type, the vector of the final drive angle at gear wheel $Z_3$ can be brought temporarily to a standstill by the addition of positive and negative elements. This is illustrated in the graphic representation in the right portion of FIG. 3.

Figure 4:
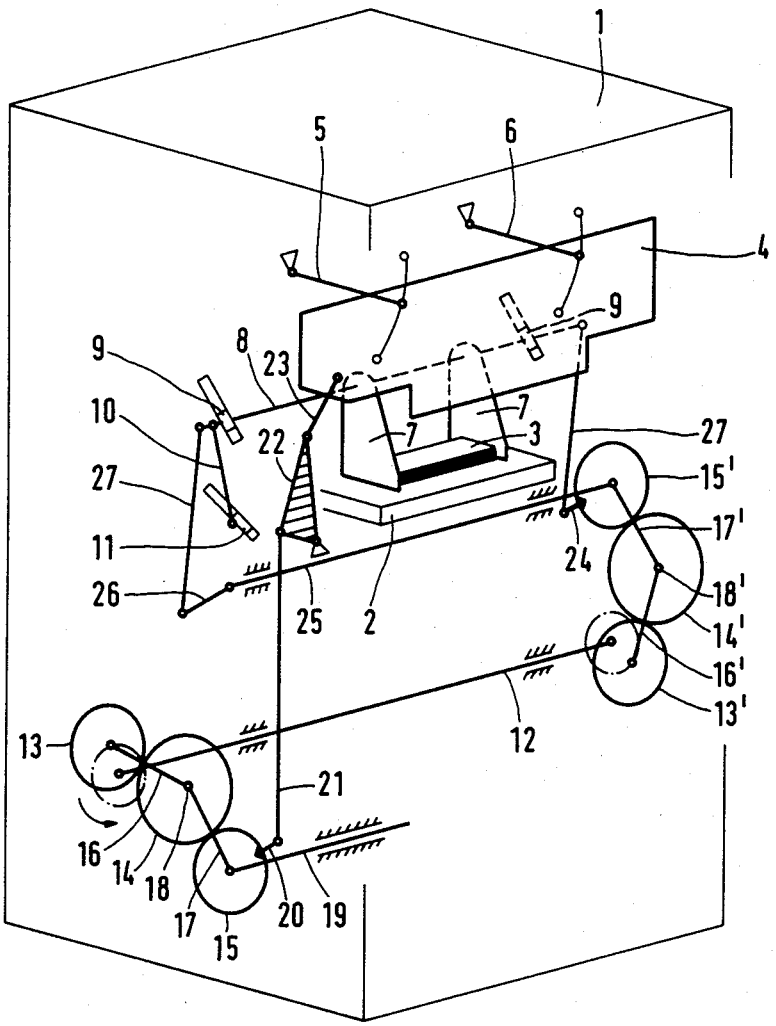
FIG. 4 indicates a schematic representation of a three-knife trimmer with the drive units for the knife assemblies.

The three-knife trimmer represented in FIG. 4 includes a machine body 1, in which a machine table 2 for the temporary reception of a stack of material 3 to be cut is provided. Delivery of the stack of material 3 to be cut is accomplished automatically by means not illustrated, and after the stack of material 3 to be cut has been positioned in its prescribed location, knife arrangements are set in motion one after the other, in order to cut first the front and immediately following that the head and foot ends of the stack.

In the machine body 1, the front knife holder 4 is held in a familiar manner in stiff vertical guides. The front knife holder 4 is suported from guide rods 5 and 6 in such a manner that the blade carries out a swinging movement with respect to the stack of material 3 to be cut and at the end of its downward movement stand parallel to the machine table 2.

The two side knife holders 7 are mounted on a beam 8 in such manner that they do not turn but can be shifted axially. The beam 8 is carried in stiff straight guides 9 in the machine body 1 and carries on one end a lever 10 which is attached so as not to turn. The free end of the lever 10 is connected to a block which slides in a guide 11 and produces thereby a swinging cut of the side knife holders 7 with respect to the stack of material 3 to be cut and the parallel positioning of the knife blades on the machine table 2 at the end of the cutting motion. The drive of the front knife holder 4 and the two side knife holders 7 is accomplished in phases by a single-revolution shaft 12 mounted in the machine body 1. Between the singe-revolution shaft 12 and the knife holders are located gear units which are further clarified below, and which carry out one work cycle per revolution of the single-revolution shaft 12.

The single-revolution shaft 12 carries on one end an eccentrically fixed first gear wheel 13, which is connected to a third gear wheel 15 through an intermediate wheel 14. The gear wheels 13, 14, 15 correspond, in that order, to the gear wheels $Z_1$, $Z_2$, and $Z_3$ and FIGS. 1 and 3, and the single-revolution shaft 12 corresponds to the bearing point $M_{AN}$ in FIGS. 2 and 3. The distances between the axes of intermediate wheel 14 on the one hand and the gear wheels 13 and 15 on the other are fixed by guide rods 16 and 17, whereby the guide rods 16 and 17 have the same length and the gear wheels 13 and 15 have the same number of teeth and thus have a gear ratio of 1:1. The guide rods 16, 17 and the gear wheel 14 carry out turning movements relative to each other at the common centerpoint 18.

The guide rod 17 and the gear wheel 15 are both supported on a shaft 19 and also carry out turning movements relative to each other.

A crank 20 is firmly attached to gear wheel 15 at an exactly defined position and operates, through a push rod 21 with ball joints, a double-armed lever 22, which is mounted in the machine body 1 in such manner that it can turn. The turning movement of this double-armed lever 22 is transmitted to the front knife holder 4 through a push rod 23 and produces the movement of the front knife.

The other end of the single-revolution shaft 12 carries similarly an eccentrically fixed gear wheel 13', which is connected to a third gear wheel 15' through an intermediate wheel 14'. The guide rods 16' and 17' and the cneterpoint 18' have the same functions as described above.

A crank 24 and a crankshaft 25 are firmly attached to gear wheel 15' at an exactly defined position. At the other end of the crankshaft 25 is located a crank 26. The cranks 24 and 26 are arranged to work in phase and have the same crank radius. The uneven turning motion of the cranks 24 and 26 is transmitted to the side knife beam 8 through two parallel push rods 27 and produces the movement of the side knives.

Figure 5:
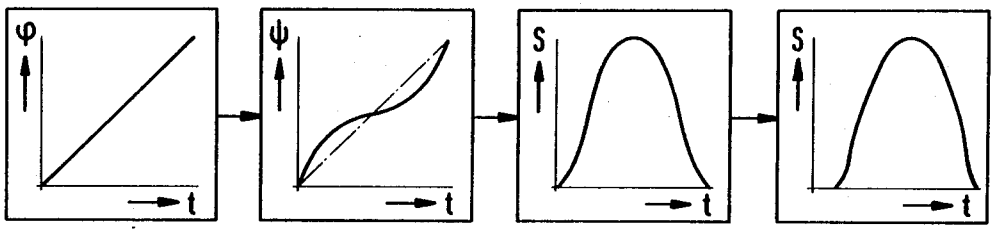
FIG. 5 indicates a graphic representation of the displacement translation function of the drive shaft, the two intervening units and the final drive.

In the graphic representation of FIG. 5 the distance-transmission functions of the individual gear units from the single-revolution shaft to the knife movement are shown in a block schematic. At the left, the uniform turning motion of the single-revolution shaft is represented by a straight line on the distance/time graph. In the motion of the operating unit A a distance/time curve that runs partially horizontally can be seen. This is compounded with the sinusoid course of the guide unit B into a motion with a pronounced rest period in the final drive, which is shown by the horizontal portion at the beginning of the distance/time curve.

Figure 6:
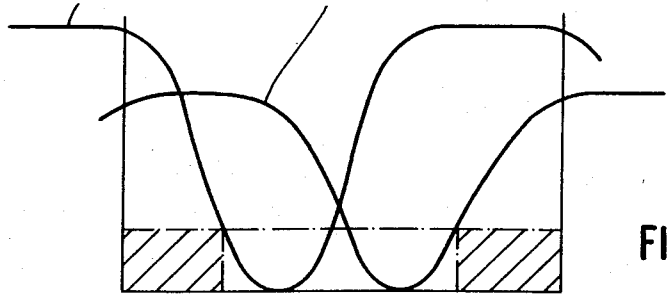
FIG. 6 indicates the motion of front knife and side knives over time.

FIG. 6 shows the course of final drive motion of the front knife and the side knives over time, and it can be seen that the cutting movements of these knife arrangements occur one after the other and that there is a common rest period, in which removal and insertion of the material being cut can be carried out between the cuts.

In the illustrated embodiment the guide units consist of an eccentric push-crank drive for the side knives and a crank arm with oscillating drive in open rectangular arrangement for the front knife. Of course, these units can also be altered or replaced.

The purposeful composition of movements of the individual gear units, as provided in the invention, yields a drive performance with a defined rest period and harmonic shares of the individual movement functions, so that in this way the speed necessary for practical use in high efficiency production lines is attained and up to 100 work cycles per minute or more can be carried out.

FIG. 6 shows that the period of time of cut in the pile height amounts to about half the length of a cycle. Thus it is possible to use the second half of the cycle period for the functions "transport" and "positioning."

What is claimed is:

1. In a trimmer for books, magazines or the like including a knife assembly having a front knife and at least one side knife, guide means formed and coupled for guided displacement of said front knife and said side knife, and drive means including a rotatable shaft coupled to produce sequential displacement of said front knife and said side knife during a single revolution of said shaft, wherein the improvement in said trimmer comprises:

said drive means further including at least two separate gear trains each coupled for driving by said shaft and with one of said gear trains being coupled to said front knife and a remainder of said gear trains being coupled to said side knife to produce displacement thereof, at least one of said gear trains being provided by a first set of gear wheels including a first gear wheel eccentrically mounted to said shaft, a third gear wheel coupled to drive the knives, and an intermediate gear wheel movably coupled to follow said first gear wheel during eccentric movement while engaging and driving said third gear wheel to provide a gear train with a gear ratio which changes over one revolution of said shaft to enable dwell of the displacement of knives during each cycle of said shaft for positioning and removal of objects to be trimmed in registration relative to the knives.

2. The trimmer as defined in claim 1 wherein, said first gear wheel and said third gear wheel have a gear ratio of 1:1.

3. The trimmer as defined in claim 1, further comprising, a first connecting guide rod mounted between the center of said first gear wheel and the center of said intermediate gear wheel, and a second connecting guide rod mounted between the center of said intermediate gear wheel and the center of said third gear wheel, said first connecting guide rod and said second connecting guide rod being mounted to permit pivotal movement of said first gear wheel and said intermediate gear wheel relative the center of said third gear wheel upon rotation of said shaft.

4. The trimmer as defined in claim 3 wherein, said first connecting guide rod and said second connecting guide rod have the same length.

5. The trimmer as defined in claim 1 wherein, said remainder of said gear trains is provided by a second set of three gear wheels substantially identical to said first set of gear wheels, with a first gear wheel in said second set of gear wheels eccentrically mounted to said shaft opposite the location of said first gear wheel in said first set of gear wheels, said front knife being coupled for driving by one of said first set of gear wheels and said second set of gear wheels, and said side knife being coupled for driving by a remainder of said first set of gear wheels and said second set of gear wheels.

6. The trimmer as defined in claim 5 wherein, said front knife is coupled to one of said gear trains by a crank arm mounted to a third gear wheel in one of said first set of gear wheels and said second set of gear wheels, a first push rod pivotally coupled to said crank arm, a second push rod pivotally coupled to said front knife, and lever means pivotally mounted to said trimmer and having one arm pivotally coupled to said first push rod and another arm pivotally coupled to said second push rod.

7. The trimmer as defined in claim 5, wherein, said side knife is coupled to said remainder of said gear trains by a crank mounted to a third gear wheel in the remainder of said first set of gear wheels and said second set of gear wheels, and a crankshaft pivotally coupled to said crank and to said side knife.

* * * * *